US007423262B2

(12) United States Patent
Mordehai et al.

(10) Patent No.: US 7,423,262 B2
(45) Date of Patent: Sep. 9, 2008

(54) PRECISION SEGMENTED ION TRAP

(75) Inventors: Alexander Mordehai, Santa Clara, CA (US); James Bertsch, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 250 days.

(21) Appl. No.: 11/273,787

(22) Filed: Nov. 14, 2005

(65) Prior Publication Data

US 2007/0114391 A1 May 24, 2007

(51) Int. Cl.
*H01J 49/42* (2006.01)

(52) U.S. Cl. ..... 250/292; 250/396 R

(58) Field of Classification Search ..... 250/292, 250/396 R

See application file for complete search history.

(56) References Cited

U.S. PATENT DOCUMENTS 3,553,451 A 1/1971 Uthe
4,731,533 A * 3/1988 Vestal ..... 250/292
5,063,294 A 11/1991 Kawata et al.
5,384,461 A 1/1995 Jullien et al.
5,852,270 A 12/1998 Holkeboer
6,469,299 B2 10/2002 Chutjian et al.
6,528,798 B1 3/2003 Busky
6,723,986 B2 * 4/2004 Kernan et al. ..... 250/292
6,797,950 B2 * 9/2004 Schwartz et al. ..... 250/292
6,849,846 B2 2/2005 Bertsch
6,926,783 B2 * 8/2005 Loucks, Jr. ..... 156/73.6
2002/0117247 A1 8/2002 Loucks, Jr.
2005/0017170 A1 1/2005 Schwartz et al.

* cited by examiner

*Primary Examiner*—Kiet T Nguyen

(57) ABSTRACT

The invention provides an ion trap assembly. In general terms, the ion trap assembly contains: a) a segmented linear ion trap; b) an insulator disposed around the segmented linear ion trap; and c) a bonding material for attaching and spacing the insulator and said segmented linear ion trap. The ion trap assembly is generally made by mounting an elongated conductive workpiece to a set of rigidly connected insulators using a bonding material, and cutting the elongated conductive workpiece into a plurality of rods using wire electrical discharge machining. Also provided is a mass spectrometry system containing the precision segmented linear ion trap.

18 Claims, 7 Drawing Sheets

PRECISION SEGMENTED ION TRAP

BACKGROUND

Mass spectrometry is an analytical methodology used for qualitative and quantitative determination of chemical compounds in a chemical or biological sample. Analytes in a sample are ionized, separated according to their mass by a spectrometer and detected to produce a mass spectrum. The mass spectrum provides information about the masses and in some cases the quantities of the various analytes that make up the sample. In particular embodiments, mass spectrometry can be used to determine the molecular weight or the molecular structure of an analyte in a sample. Because mass spectrometry is fast, specific and sensitive, mass spectrometer devices have been widely used for the rapid identification and characterization of biological analytes.

Mass spectrometers may be configured in many different ways, but are generally distinguishable by the ionization methods employed and the ion separation methods employed. For example, in certain devices parent analyte ions are isolated, the parent ions are fragmented to produce daughter ions and the daughter ions are subjected to mass analysis. The identity and/or structure of the parent analyte ion can be deduced from the masses of the daughter ions. Such devices, generally referred to as tandem mass spectrometers (or MS/MS devices) may be coupled with a chromatography system (e.g., a GC or HPLC system or the like) and a suitable ion source (e.g. an electrospray ion source) to investigate analytes in a liquid sample.

Certain mass spectrometry systems employ a linear ion trap (otherwise known as a "two-dimensional" ion trap) in order to obtain mass information about ions. The most basic linear ion trap contains four conductive rods arranged to form a quadrupole, and a pair of plates that cap the ends of the quadrupole. Ions are trapped within the quadrupole by an RF trapping field produced by the rods and a DC trapping field that is produced by the pair of plates. In this case, the quadrupole is non-segmented in that it contains a total of four rods. Because of the design of non-segmented ion traps, ions present in a non-segmented ion trap may be exposed to significant non-linear fringe fields. Such fringe fields can excite ions and cause their loss from the ion trap.

The efficiency of linear ion traps has been greatly improved by dividing the quadrupole into spatially separate segments, and linearly arranging those segments in tandem to form a segmented ion trap. Each segment of a segmented ion trap contains four rods that may be, but not always, hyperbolic in cross-section in order to match the equipotential contours of the RF field desired within the segment. Segmented ion traps generally contain from three to twelve segments, although segmented ion traps containing more than twelve segments could be employed in many applications. One type of segmented ion trap illustrated in FIG. 1 contains three segments: a front segment 2, a central segment 4 and a back segment 6. The two end segments differ in DC potential from the central section to form a "potential well" in the center section to constrain ions axially. In this example, a slot in one or more of the rods in the central segment allows resonant ions to be ejected radially out of the central segment in response to a particular RF field applied to the central segment. The ejected ions may be detected using a detector that is adjacent to the ion exit of the slot. By varying the magnitude of the RF voltage applied to rods in the central segment, ions can be ejected in order of their m/z and, as such, an ion trap may be used to determine the mass of unknown ions in a sample.

Because ions are trapped within a segmented linear ion trap in a long, narrow, generally cigar-shaped cloud that may span several segments, segmented linear ion traps are exquisitely sensitive to mechanical imperfections. In order to produce a highly sensitive, high-resolution segmented ion trap, it is imperative to manufacture the ion trap so that the segments are precisely aligned and contain rods that are parallel to each other within high tolerances. For this reason, the manufacture of segmented ion traps presents a unique manufacturing problem. This problem is compounded in manufacturing ion traps containing larger number of segments (e.g., 9 to 12 segments) since systematic errors (rather than random errors) will have more of an effect.

Prior art methods for manufacturing segmented linear ion traps generally involve mounting pre-made rods onto a precision-made insulators using precision spacers and screws. However, such methods are generally very expensive to perform, both in terms of parts and labor.

In view of the above, improved methods for manufacturing a segmented linear ion trap are needed. The invention described herein meets this need, and others.

SUMMARY OF THE INVENTION

The invention provides an ion trap assembly. In general terms, the ion trap assembly contains: a) a segmented linear ion trap; b) an insulator disposed around the segmented linear ion trap; and c) a bonding material for attaching and spacing the insulator and said segmented linear ion trap. The ion trap assembly is generally made by mounting an elongated conductive workpiece to a set of rigidly connected insulators using a bonding material, and cutting the elongated conductive workpiece into a plurality of rods using wire electrical discharge machining. Also provided is a mass spectrometry system containing the precision segmented linear ion trap.

DEFINITIONS

Figure 1:
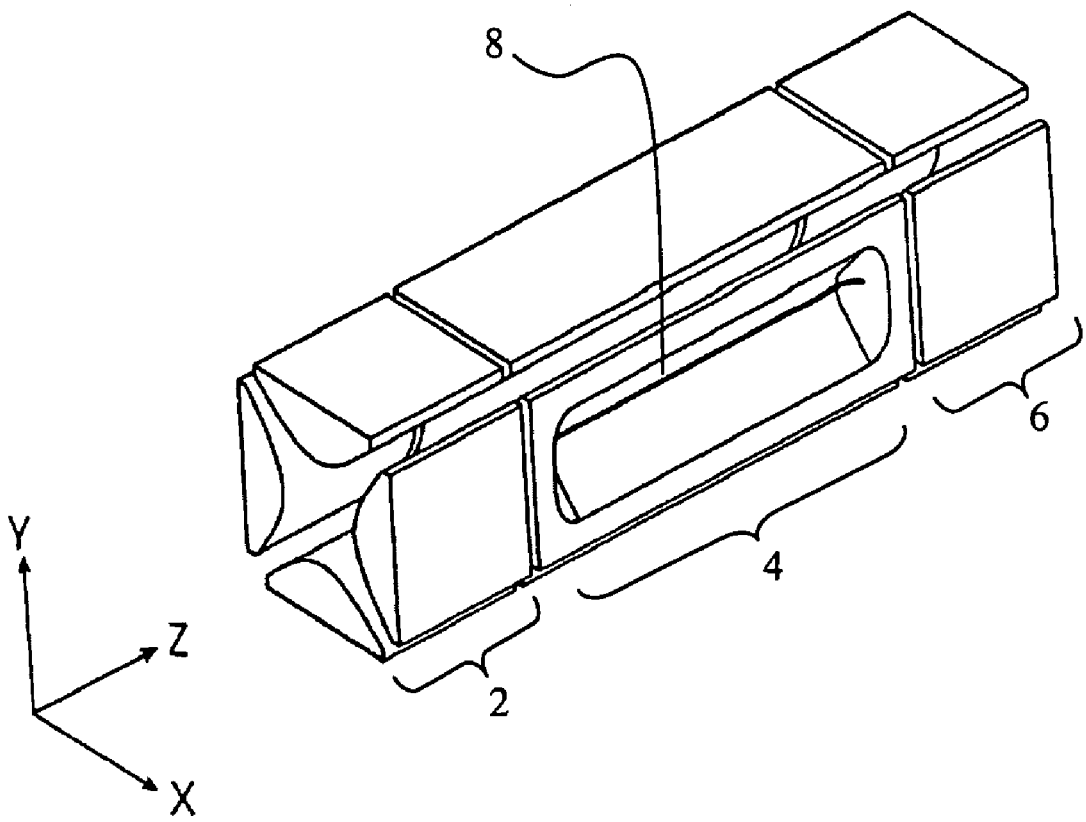
FIG. 1 is a drawing showing the arrangement of rods in an exemplary segmented linear ion trap.

The term "rod" is used herein to describe an elongated electrode employed in a linear ion trap. A rod may have any cross-sectional shape.

A "plurality" is at least 2, e.g., 2, 3, 4, 6, 8, 10, 12 or greater than 12. The phrases "a plurality of" and "multiple" are used interchangeably. A plurality of rods or a plurality of insulators contains at least a first rod and a second rod, or at least a first insulator and a second insulator, respectively.

The term "segment" refers to a distinct portion of a segmented ion trap. A segment of a segmented ion trap typically contains four rods arranged in parallel, each rod connected to an insulator. A segmented ion guide contains at least three segments arranged in tandem along an ion flight path.

The term "orifice" is intended to encompass any type of opening, e.g., an aperture, of any shape. An orifice is defined by an orifice wall.

The term "wire electrical discharge machining" or "wire EDM" for short refers to any milling process that employs a wire electrode that travels through a workpiece to cut the workpiece by electrical discharge erosion.

A "workpiece" refers to a composition that may be of any shape. A workpiece may be a monolithic block (or "blank" as it may also be referred in the milling arts), or a composite containing two or more different pieces (e.g., two or more monolithic blocks separated, e.g., sandwiched, by a spacer or two or more machined pieces supported on a central mandrel) for example.

A "bonding material" refers to adjoining material that bind to the surfaces of two objects and rigidly hold those objects proximal to each other. Bonding materials include adhesive, solder, and braze and are general applied to space between two objects as a liquid. Once interposed between the two objects, the bonding material solidifies to become a rigid joint between two objects. The term "bonding material" excludes compression-type devices such as screws and clamps.

A "cured" adhesive is an adhesive that is set, i.e., hardened. Adhesives may be cured by heating the adhesive or by exposure to ultra-violet light, for example.

Reference to a singular item includes the possibility that there are plural of the same. More specifically, as used herein and in the appended claims, the singular forms "a," "an," "said" and "the" include plural referents unless the context clearly dictates otherwise.

Further definitions may occur throughout the Detailed Description of the Invention.

DETAILED DESCRIPTION OF THE INVENTION

The invention provides an ion trap assembly. In general terms, the ion trap assembly contains: a) a segmented linear ion trap; b) an insulator disposed around the segmented linear ion trap; and c) a bonding material for attaching and spacing the insulator and said segmented linear ion trap. The ion trap assembly is generally made by mounting an elongated conductive workpiece to a set of rigidly connected insulators using a bonding material, and cutting the elongated conductive workpiece into a plurality of rods using wire electrical discharge machining.

In certain embodiments, an ion trap assembly may contain: a) an elongated support and b) at least three segments arranged in tandem, each segment containing: i) an insulator that contains an orifice and that is connected to said elongated support; ii) a plurality, e.g., at least four, parallel rods that extend through the orifice and spaced from the insulator; and iii) a bonding material attaching each of the rods to the insulator. In particular embodiments, the ion trap may contain: a) a segmented linear ion trap containing a first section, a second section and a third section; b) a first insulator disposed around said first section but not in direct contact with the first section; c) a second insulator disposed around the first section but not in direct contact with the second section; d) a third insulator disposed around the first section but not in direct contact with the third section; and e) a bonding material that attaches the first, second and third insulators to the first, second and third sections.

Methods recited herein may be carried out in any logically possible order, as well as the recited order of events. Furthermore, where a range of values is provided, it is understood that every intervening value, between the upper and lower limit of that range and any other stated or intervening value in that stated range is encompassed within the invention.

The referenced items are provided solely for their disclosure prior to the filing date of the present application. Nothing herein is to be construed as an admission that the present invention is not entitled to antedate such material by virtue of prior invention.

As noted above, segmented linear ion traps generally contain at least three and sometimes up to twelve (e.g., 3, 4, 5, 6, 7, 8, 9, 10, 11 or 12) or more discrete segments, each containing at least four conductive rods that can be, although not always, substantially hyperbolic. Each rod has a longitudinal axis, and the longitudinal axes of the rods of each segment are parallel with each other to form an ion passageway. Each segment of a segmented linear ion trap has a longitudinal axis, and the longitudinal axes of the segments of a segmented linear ion trap are aligned with each other in tandem. Each rod of a segment of a segmented linear ion trap is generally adjacent to and spatially isolated from (i.e., spaced from) a rod in at least one adjacent segment. A representative arrangement of rods in a segmented linear ion trap is illustrated in FIG. 1. In this figure, as per convention, the x, y and z axes are shown. The longitudinal axis is the z axis. The opposing rods of each section of a segmented linear ion trap are generally paired in that they receive the same RF voltages. As per convention, the rod pairs aligned with the x and y axes are called the X and Y rod pairs, respectively. In certain cases and as illustrated in FIG. 1, one or more rods of a segmented linear ion trap may contain a slot through which ions are ejected out of the ion trap. The representative segmented linear ion trap illustrated in FIG. 1 contains three segments 2, 4 and 6 arranged in tandem, each segment containing four parallel hyperbolic rods. In the exemplary ion trap illustrated in FIG. 1, one rod of middle segment 4 contains slot 8 for ejecting ions. As illustrated in FIG. 1, slot 8 may be V-shaped in cross-section, with the narrowest point of the slot being disposed towards the interior of the ion trap.

With the above description in mind, the invention provides a segmented linear ion trap in which the rods of each segment are held in a parallel arrangement by a bonding material that attaches the rods to an insulator that forms a scaffold for the rods. In general terms, the insulator contains an orifice through which the rods extend without touching the insulator, and the rods are attached to the insulator using a bonding material. The bonding material forms a rigid spacer that connects each of the rods to the insulators, and the bonding material holds and positions the rods in defined parallel positions.

The segments of a segmented ion trap of the invention are connected together via at least one support that is mounted to (via an adhesive or screws, for example) the insulator of each of the segments. The support holds the segments in tandem alignment whereas the insulator, connected to both the support and the rods, holds the rods of each segment parallel to each other. The support may elongated, rigid and made of a strong material such as steel or the like. The support and the insulators, together, form a scaffold, i.e., a set of rigidly connected insulators, to which the rods are mounted via a bonding material.

Figure 2A:
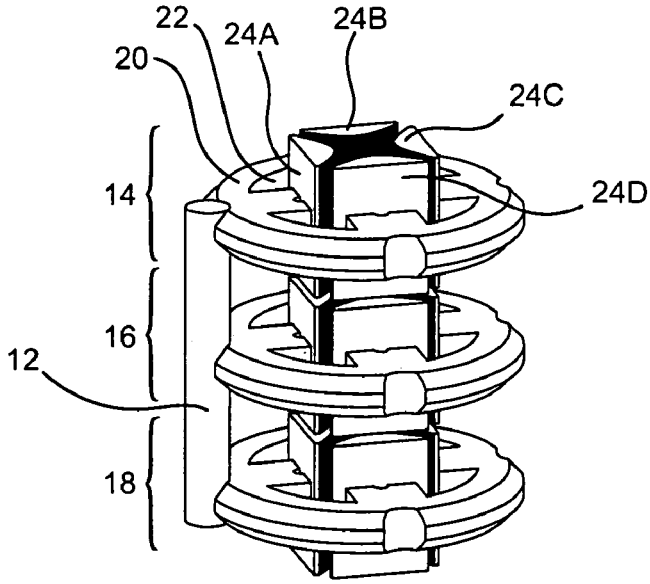
FIG. 2A-2C illustrate exemplary embodiments of the invention.
Figure 2B:
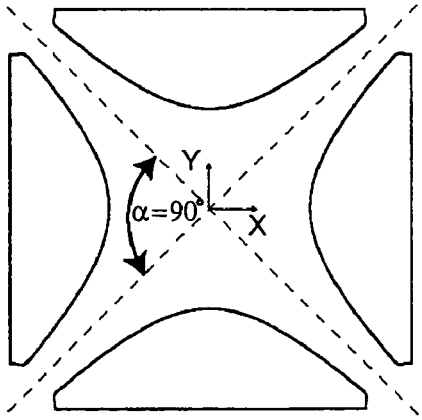
Figure 2C:
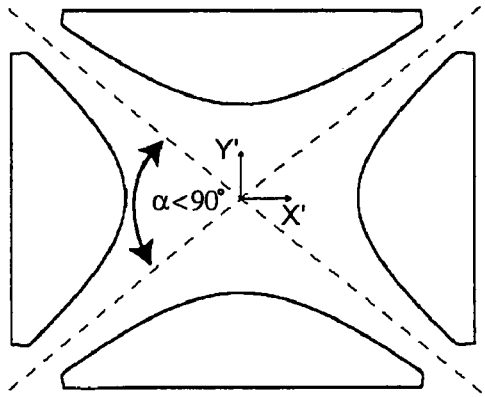

An exemplary embodiment of this aspect of the invention is illustrated in FIG. 2A. FIG. 2A illustrates a representative segmented linear ion trap of the invention containing an elongated support, e.g., support 12 and a plurality of segments 14, 16 and 18 arranged in tandem. With reference to exemplary segment 14, each segment contains: a) an insulator (e.g., insulator 20) connected to the elongated support 12, the insulator having an orifice 22, b) four parallel rods 24A, 24B, 24C and 24D, each of which extends through the orifice 22, and c) a bonding material attaching each of the rods to the insulator (not shown). In the embodiment shown in FIG. 2A, the rods are hyperbolic in cross-section, although rods having any cross-sectional shape, e.g., a cross sectional shape that is circular, oval, semi-circular, concave, flat, square, rectangular, substantially hyperbolic, or multisided, may also be employed. For example and as illustrated in FIG. 2B, a segmented ion trap containing hyperbolic rods can have four rods containing an identical hyperbolic cross-section. In another example and as illustrated in FIG. 2C, a segmented ion trap containing hyperbolic rods can have pairs of opposing pairs of rods that have different hyperbolic cross-sections. In the embodiment shown in FIG. 2C, opposing pairs of rods that have different hyperbolic cross sections may be aligned so that the angles defined by the hyperbola asymptotes are not 90°. The rods are generally spaced from the insulator to which they are attached. In certain embodiments, the rods are spaced from the insulators to which they are attached by a distance in the range of about 5 μm to about 2 mm, e.g., about 10 μm to about 0.5 mm.

Further, and as will be described in greater detail below, the precision ion trap of the invention may contain one or more slots to allow ions to pass out of the ion trap. A rod containing a slot may be at any position within the ion trap, and particularly contained in a central segment in the trap. One, two, three or four rods may contain a slot in a particular ion trap segment. A slot may extend the entire length of a rod or may extend a portion of the rod and, in certain embodiments, may be V-shaped (as illustrated in FIG. 1) with the narrowest part of the slot being an opening to the ion passageway of the ion trap.

The insulators used in a precision ion trap of the invention are generally made of an insulating material (e.g., a ceramic or metal oxide such as aluminum oxide or zirconium oxide) and, in certain embodiments and as will be described below, may contain one or more connectors, notches, glue holes, structures or recesses for mounting the insulators to a workpiece or support. An insulator employed herein may be of any shape or size (an insulator may be shaped like a triangle, square, circle or hexagon, for example) and need not be precision machined. An insulator generally contains an orifice (which may be of any shape) through which rods may be disposed. In the embodiment shown in FIG. 2A, the insulators employed are generally ring-shaped (i.e., have a substantially circular outside wall and a substantially circular inside wall). Each segment of a segmented ion trap contains at least one insulator that is mounted to a support and at least four rods. Certain segments may contain more than one insulator (e.g., 2, 3 or 4 insulators), particularly if that segment contains a slotted rod. In particular embodiments, if a segment has a slot that is to be employed for ion ejection, the segment may contain at least two insulators positions at the ends of the rods of that segment.

In certain embodiments the materials used for the rods and the insulators may be chosen so that the interior dimension of the ion passageway (i.e., the shortest distance between two opposing rods in a cross-section) is held substantially constant as the temperature of the assembly fluctuates around its operating temperature. This can be done by employing an insulator made from a material that has a lower or the same thermal expansion coefficient than the material used for the rods with appropriate selection for the relative rod to insulator dimensions. The use of thermal expansion matched materials for the conductors and rods allows the larger insulator thermally expand out from the longitudinal axis of the ion trap at substantially the same rate as the smaller rods thermally expand towards the longitudinal axis of the ion trap, thus precisely maintaining the internal diameter of the ion passageway.

The invention further provides a method of making the precision segmented linear ion trap described above. The method generally involves: a) placing an elongated conductive workpiece through each orifice of a plurality of rigidly connected insulators such that the longitudinal axis of the conductive workpiece extends through each orifice of the insulators; b) affixing the elongated conductive workpiece to the insulators using an bonding material; and c) employing wire electrical discharge machining (EDM) to cut the elongated conductive workpiece to produce a desired number of segments, each segment containing four rods attached to an insulator. In other words, prior to EDM, a conductive workpiece (e.g., a monolithic block of metal or, as will be described below, two or four blocks of metal separated by spacers, or pre-machined rods secured to a mandrel, for example) is mounted onto a set of rigidly connected insulators (i.e., a set of insulators securely mounted onto a rigid support), prior to fashioning the rods using EDM. As will be described in greater detail below, EDM is used to make, minimally, at least transverse cuts through the conductive workpiece. However, a combination of transverse and longitudinal cuts may be made in certain embodiments.

The cuts in the workpiece are done using wire EDM. Wire EDM is a milling technique that employs a spool of conductive wire (which may be made from brass, tungsten or a zinc-or silver-coated alloy, for example) that is under tension and generally has a diameter in the range of about 0.3 mm to about 10 μm, although wire having a dimensions outside of this range may also be employed in certain embodiments. A high frequency pulsed DC voltage is applied to the wire, and upon its contact with a workpiece, the wire cuts through the workpiece by spark erosion. Wire EDM produces extremely precise, straight cuts that have a width that is marginally greater than the wire used. Wire EDM is generally done in the presence of a dielectric fluid such as de-ionized water or dielectric oil in order to provide an inert atmosphere, flush away removed workpiece and cool the cut site. Wire movement through a workpiece in three dimensions may be computer numerically controlled (i.e., by CNC) to provide a system in which cuts can be reproducibly and accurately produced in two or three dimensions. Systems and methods for wire EDM are known in the art (see, e.g., U.S. Pat. Nos. 6,621,033, 6,437,277 6,078,019 5,306,889, for example).

The above-described method may be practiced a number of different ways, using a variety of different shapes and arrangements of conductive workpieces. Exemplary protocols for practicing the above-described method are set forth below.

Figure 3A:
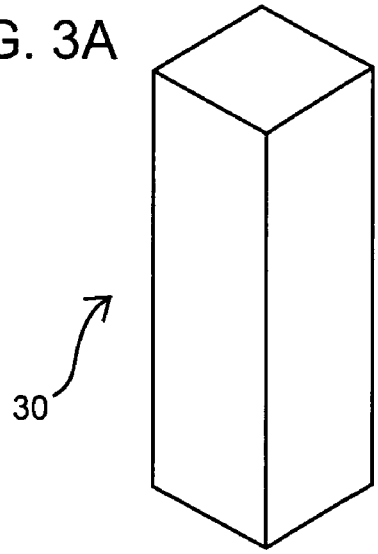
FIGS. 3A-3D illustrate exemplary workpieces that may be employed in the methods of the invention.
Figure 3B:
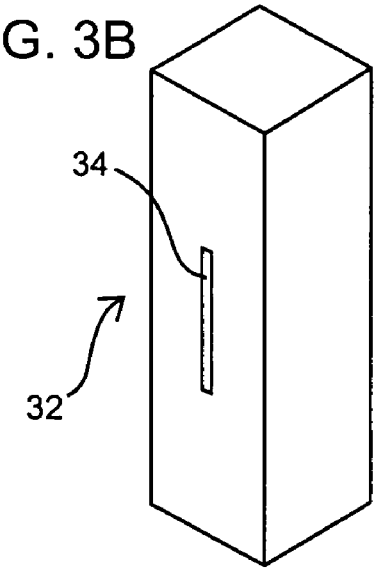
Figure 3C:
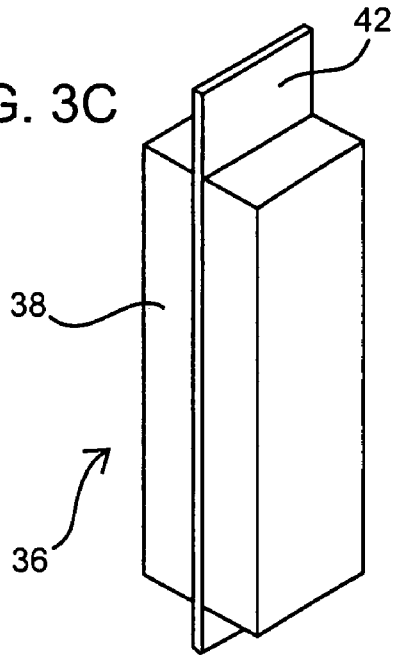
Figure 3D:
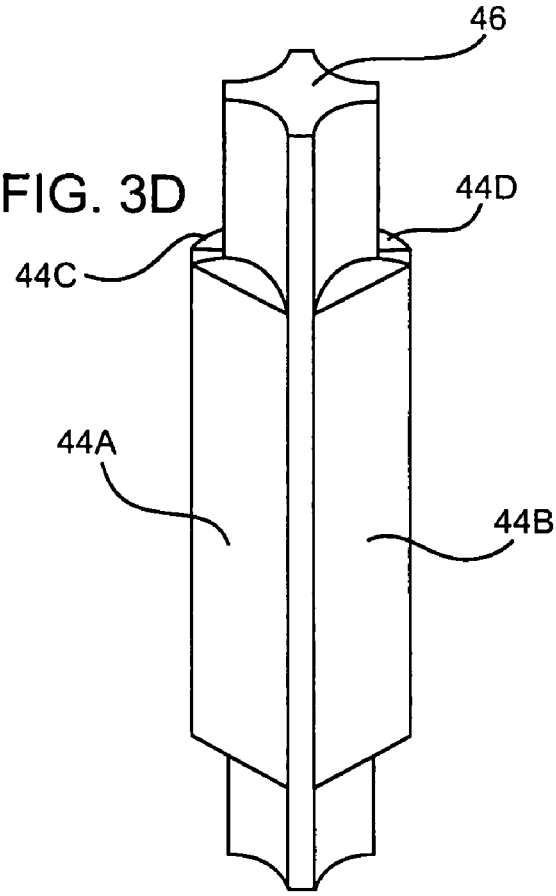

As noted above, a workpiece (or "blank" as it may be called) may be employed in the above-described method. Exemplary workpieces are illustrated in FIG. 3A-3D. A workpiece that may be employed is generally elongated and thereby contains a longitudinal axis. A workpiece contains at least one, and in certain cases two, three or four or more conductive sections that are to be cut into rods by wire EDM. The conductive sections of the workpiece may be made from any material suitable for use as a rod of a subject in trap. In certain embodiments, the conductive section of a workpiece may be made from a metal (e.g., molybdenum, aluminum or stainless steel such as 316 stainless steel)) or a conductive ceramic for example. If a workpiece contains more than one conductive section, the sections are usually elongated and have longitudinal axes that lie parallel the longitudinal axis of the workpiece. Representative workpieces are illustrated in FIGS. 3A-3D, and how those workpieces may be employed in the subject methods will be described in greater detail below. In one embodiment and as illustrated in FIG. 3A, a workpiece may be a single monolithic block of conductive material 30 (e.g., a single block of metal). As illustrated in FIG. 3A, the block may be pillar shaped having four planar sides, although a block of virtually any shape may be employed. As illustrated in FIG. 3B, a monolithic block 32, if employed, may have a pre-machined slot 34 that becomes a slot in a rod once the block is cut into rods. The slot, if present, may extend through the block from one side to the other, and may be machined by wire EDM or another precision milling method. As illustrated in FIG. 3C, the workpiece may be a composite, structure 36 containing two conductive sections 38 and 40, separated by a spacer 42 (i.e., a shim). The space between the sections formed by spacer 42 becomes a slot that extends through adjacent rods down the entire length of the ion trap (and also down opposite sides of the ion trap) once the workpiece is cut into rods and the spacer is removed. In another embodiment and as illustrated in FIG. 3D, the workpiece may be a composite containing a four precision machined conductive rods 44A, 44B, 44C and 44D supported by a mandrel 46. The mandrel positions the rods so that the longitudinal axes of the rods are parallel to each other, and holds the rods in their position during wire EDM. In this embodiment and as will be described in greater detail below, wire EDM may produce transverse cuts across the rods to produce the ion trap. Accordingly, in this embodiment, the rods employed in the workpiece have general dimensions appropriate for use in an ion trap, except that they are substantially longer than those employed in an ion trap.

Figure 4A:
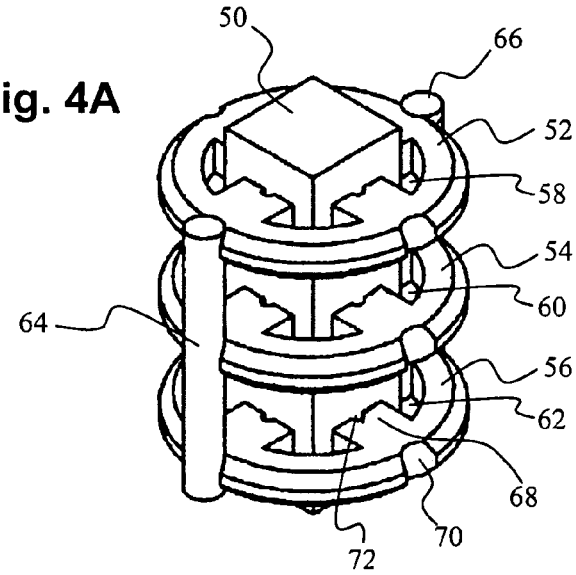
FIGS. 4A-4C illustrate exemplary workpiece-insulator-support assemblies that may me employed in the methods of the invention.

In general terms, the method summarized above involves rigidly securing a plurality of insulators containing orifices onto a rigid support in tandem such that the longitudinal axes of the orifices are aligned, and then inserting a workpiece into the orifices of the insulators (e.g., the orifices of insulator rings, for example) so that the workpiece extends through the orifices and is spaced from the insulators. An exemplary arrangement of insulators and a workpiece is illustrated in FIG. 4A. In the embodiment shown in FIG. 4A, three insulators 52, 54 and 56 containing orifices 58, 60 and 62, respectively, are rigidly secured onto a supports 64 and 66. Workpiece 50 is inserted through the orifice of each of the insulators and is securely affixed to the insulators by a bonding material. In certain embodiments there is one insulator per segment although in certain other embodiments, particularly if a segments contains a slot, a segment may contain two or more insulators. If a segment contains a slot, insulators may be positioned at the ends of a segment in order to not obstruct the passage of ions out of a slot to a detector that may be present adjacent to the slot. Also as illustrated in FIG. 4A, an insulator may be constructed to contain a connector 68 that is integral with the insulator to which the above-referenced bonding material is contacted. In certain embodiments, the connector 68 contains a conduit for applying bonding material to the workpiece from a radial direction with respect to its the longitudinal axis.

Figure 4B:
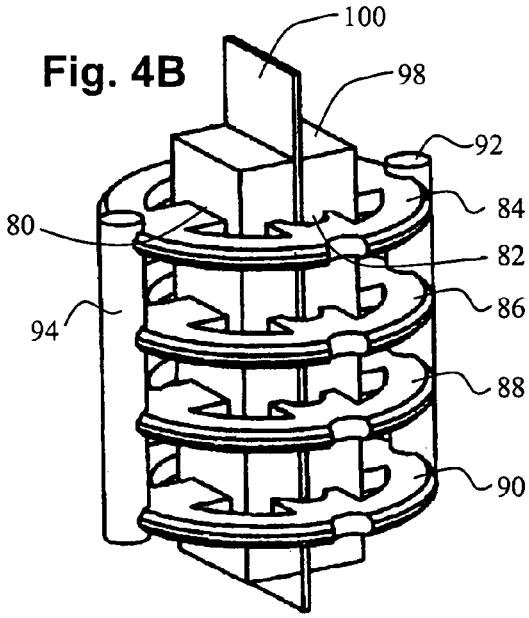

As illustrated in FIGS. 4A and 4B, the design of a connector may vary depending on the desired method by which the bonding material is to be applied, and the type of workpiece used. For example and as illustrated in FIG. 4A, a connector may contain a notch 72 for applying bonding material and/or to accommodate a slot in a rod. As illustrated in FIG. 4B, a connector may have a planar bonding material contact surface (see element 80) or may contain a notch that allows the connector to bridge two distinct two distinct conductive sections that are separated by a spacer (see element 82).

The support may be mounted onto the insulators by any suitable rigid means, such as, for example, a compression device such as a screw or clamp, or by non-compression means employing an adhesive or braze. As illustrated in FIG. 4A, an insulator may be adapted to be connected to a support in that that support may contain a recess or other mating element (e.g., recess 70) that fits with the support.

As mentioned above, a bonding material (which term is intended to encompass non-compression type jointing materials that rigidly join two objects together) is applied to the space between the insulators and the workpiece at connection points (e.g., connection point 72) and the bonding material is solidified to provide a rigid attachment between the insulators and the workpiece. Exemplary bonding materials include, but are not limited to adhesives (particularly epoxy, acrylic and ceramic glaze adhesives) that can be cured by heat or ultraviolet light, for example, brazes (e.g., metal alloys such as silver-based alloys employed in metal to ceramic brazing) and solder. The adhesive may be a vacuum epoxy, for example, such as TORR SEAL™ epoxy made by Varian instruments (Palo Alto, Calif.) and should be very hard when cured. An adhesive, if used, should have a high glass transition point that is above the operating temperature range of the completed ion trap, and should produce a relatively low amount of out gas in a vacuum. Solidification, e.g., curing of the adhesive, in certain embodiments, may be done at the proposed operating temperature of the ion trap being produced. An exemplary description of how an insulator may be mounted to a conductive rod using an adhesive is found in U.S. patent application Ser. No. 10/127,040, filed on Apr. 19, 2002 (entitled "Manufacturing precision multipole guides and filters"). The methods described therein are readily adapted to perform the instant methods. U.S. patent application Ser. No. 10/127,040 is published as US20020117247 and is incorporated herein by reference in its entirety for all purposes. As would be apparent to one of skill in the art, if a composite workpiece is employed, the workpiece should be tightly clamped prior to addition of the adhesive. In summary, any type of non-compression bonding material having a sufficiently low vapor pressure and sufficient strength to rigidly attach the rods the supporting structure within the range of operating temperatures of the ion trap can be used.

Figure 4C:
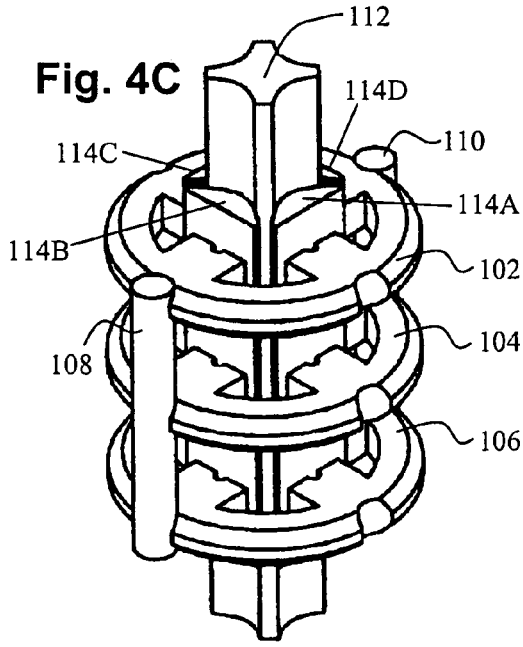

Various embodiments are illustrated with reference to FIGS. 4A-4C. FIG. 4A illustrates three insulators 52, 54 and 56 that are mounted to two supports 64 and 66 and a single block 50 (as illustrated in FIG. 3A or 3B and described in greater detail above). FIG. 4B illustrates four insulators 84, 86, 88 and 90 that are mounted to two supports 92 and 94 and a workpiece containing two conductive sections 96 and 98 separated by a spacer 100 (as illustrated in FIG. 3C and described in greater detail above). The device illustrated in FIG. 4B contains four insulators because the central spacers 86 and 88 are spaced to be at the ends of the middle segment, once that segment is made. FIG. 4C illustrates three insulators 102, 104 and 106 that are mounted to two supports 108 and 110 and a workpiece that contains a mandrel 112 and four precision machined hyperbolic rods 114A, 114B, 114C and 114D mounted with the mandrel 112 (as illustrated in FIG. 3D and described in greater detail above).

Upon setting of the bonding material (e.g., curing the adhesive or solidification of a braze), the supports, insulators and workpiece form a rigid "support-insulator-workpiece" assembly for EDM. Any of the assemblies illustrated in FIG. 4A-4C may be subjected to wire EDM. In certain embodiments and as illustrated in FIGS. 5A-5D, EDM is employed to produce transverse and longitudinal cuts through the workpiece, in any order (e.g., transverse cuts followed by longitudinal cuts or longitudinal cuts followed by longitudinal cuts). In other embodiments and as illustrated in FIG. 6, EDM may be employed to produce only transverse cuts through the workpiece to produce the linear ion trap.

Figure 5:
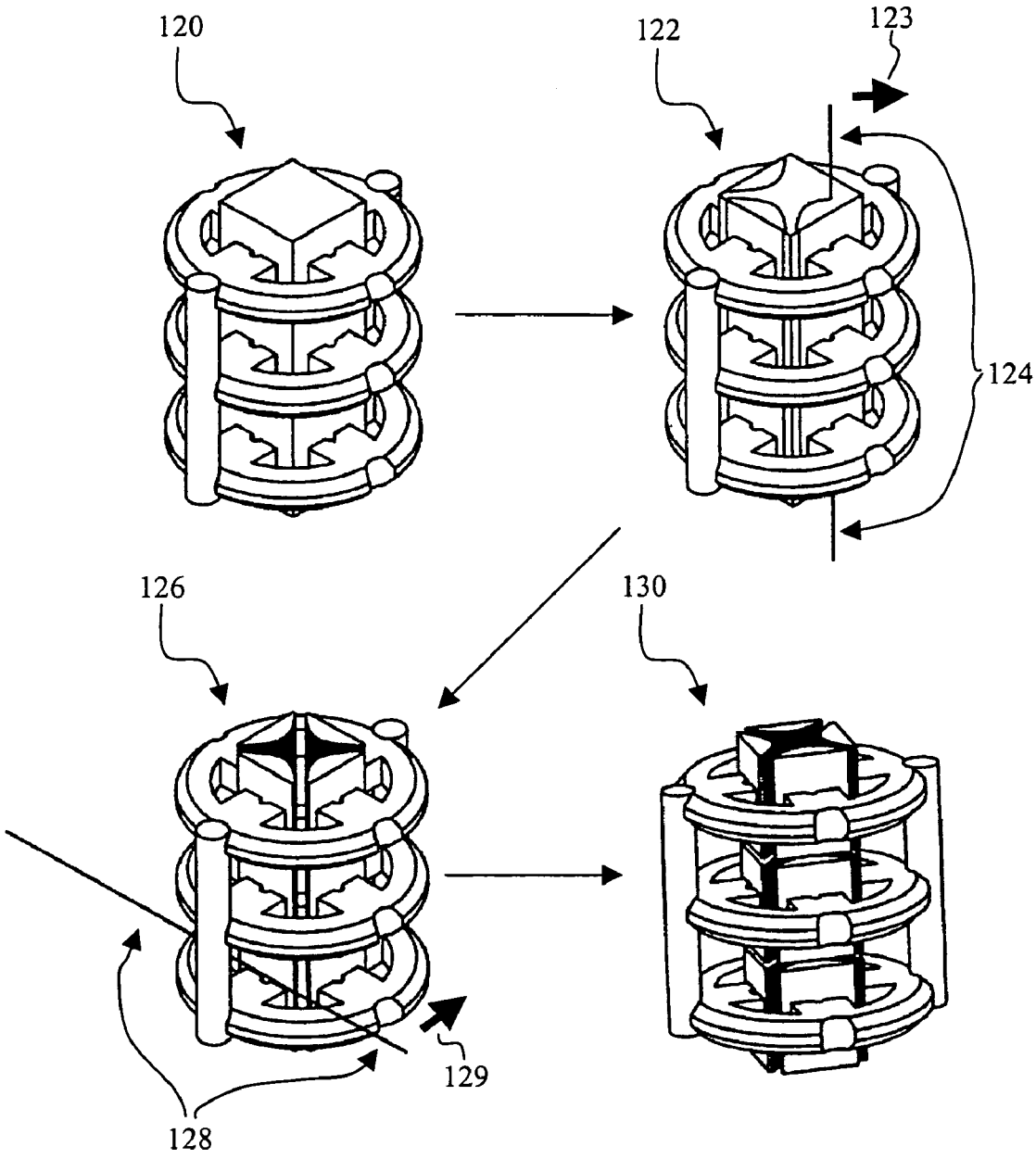
FIG. 5 schematically illustrates a first exemplary method of making a segmented linear ion trap of the invention.

By way of illustration and not limitation, an exemplary method of making a segmented linear ion trap is set forth in FIG. 5. This figure illustrates one embodiment in which a segmented linear ion trap is produced using an assembly containing a workpiece that is a single block of conductive material. The exemplary method shown in FIG. 5 is readily adapted to the use of other workpieces, e.g., the workpieces shown in FIGS. 3A-3C. The workpiece of assembly 120 is cut longitudinally using EDM wire 124 to produce assembly 122 having a workpiece containing longitudinal cuts. The direction of movement of the wire 124 through the workpiece of assembly 122 is indicated by arrow 123. The workpiece of EDM assembly 122 is cut transversely using EDM wire 128 to produce an assembly containing a workpiece having transverse cuts 126. The direction of movement of the wire 128 through the workpiece of assembly 126 is indicated by arrow 129. The longitudinal and transverse cuts may be made in any order. A segmented linear ion trap 130 is produced upon completion of the longitudinal and transverse cuts. As illustrated in FIG. 6. An assembly containing precision rods mounted onto a central mandrel can be made into a segmented linear ion trap using transverse cuts.

Figure 6:
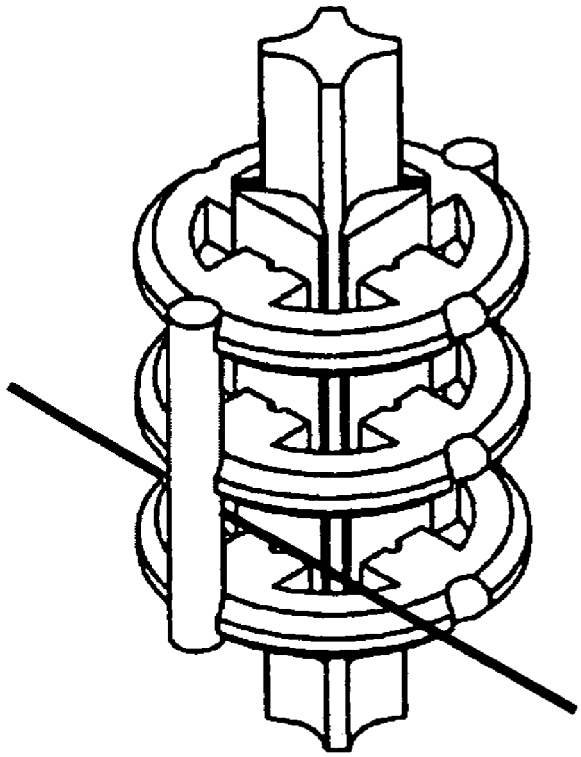
FIG. 6 schematically illustrates a second exemplary method of making a segmented linear ion trap of the invention.

In addition to the longitudinal and transverse cuts illustrated in FIGS. 5 and 6, further cuts may be made by wire EDM. For example, linear or V-shaped longitudinal cuts may be made to produce rods having slots that extend through the rod. As noted above, such slots can be used to eject ions from the ion trap.

Wire EDM, in certain embodiments, may be done at the operating temperature of the ion trap that is being made. Accordingly, the process of wire EDM may be done at a temperature in the range of 20° C. (i.e., room temperature) to about 200° C. or greater, depending on the proposed operating temperature of the device.

The above-described method produces a segmented linear ion trap that has significantly improved axial alignment and rod parallelism over ion traps made by prior art methods principally because wire EDM makes extremely straight cuts through a workpiece along the length of the wire, without putting significant stress on the workpiece. Since, in many embodiments, the rods are made by longitudinal cuts that span all of the longitudinally adjacent rods, the longitudinally adjacent rods are aligned without further adjustment. Further, the above-described methods allow a segmented ion trap to be fabricated using a significant reduction in the number of parts. For example, a traditional 3-segment hyperbolic ion trap having 12 rod elements, a back end plate, a font end plate and a single spacer per gap would require about 18 precision spacers. The methods described herein can be used to make the same ion trap without using precision spacers. The methods described above also significantly reduce the assembly and adjustment time for producing a segmented ion trap.

The methods described herein provide an ion trap having very high resolution for mass selection or mass scanning, and good trapping efficiency, without making any time-consuming measurements of distances between parts. Further, the above method provides an ion trap having very small and consistent gaps between the rods of adjacent segments of an ion trap (e.g., as low as about 5 μm to about 100 μm, for example). Such small and consistent spacing is difficult or impossible to achieve by other techniques.

In summary, the invention provides a for making a precision segmented ion trap that requires no precision machined spacers or precision machined insulators, thus reducing manufacturing costs and assembly time. The precision alignment of the components of the ion trap is achieved by subjecting a pre-assembled structure (termed an "assembly" herein) to wire EDM, thus ensuring that no cumulative systematic errors are introduced into the device.

The methods described above particularly allow the fabrication of segmented ion traps that have design features that would otherwise make them challenging to produce. Such segmented ion traps include, but are not limited to: ion traps having more than three segments (e.g., for ion traps that can simultaneously trap both positive and negative ions or ion traps designed to concentrate ions close to one of the ends of the ion trap), ion traps having one or more V-shaped (wedged) slots that span the entire length of the ion trap, ion traps containing a rod containing a slot (particularly a V-shaped slot) having a narrow entrance (e.g., of 50-500 μm or less), ion traps containing rods pairs that have different cross-sections (e.g., different hyperboles), and ion traps containing rods having hyperboles with asymptotes that are not aligned at 90° angle with respect to each other.

The above description is set forth to exemplify a method for making an ion trap containing segments each containing four rods (i.e., "quadrupole" ion traps). The above methods are readily adapted to the production of ion traps containing segments having more than four rods, e.g., six or eight or more rods.

Conventional end caps (or entrance and exit lenses) may be mounted onto the ends of the segmented ion trap described herein, and the ion trap may be used as any other ion trap would be used.

For example, the ion trap may be employed under vacuum using standard RF and/or DC voltages to trap ions, cool ions in the presence of a neutral gas (e.g., $N_2$), and eject ions radially towards a detector, for example. The ion trap described herein may be operated in a scanning mode or non-scanning mode. Further, an ion trap produced by the instant methods may have minimal gaps between sections and may be employed as a quadrupole mass filter.

Figure 7:
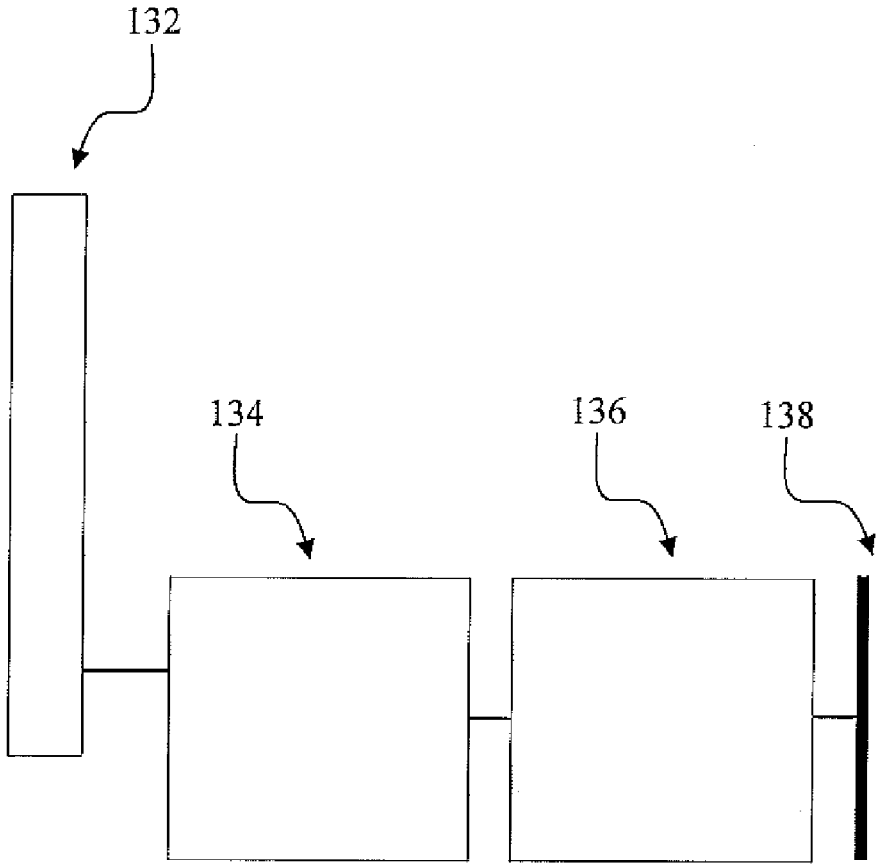
FIG. 7 schematically illustrates an exemplary mass spectrometer system.

The subject ion trap may be employed as part of a mass spectrometer system, exemplified by FIG. 7. that minimally contains in addition to ion trap 136, an ion source 134 upstream from the ion trap, and an ion detector 138 downstream from the detector ion trap.

The ion source employed in a subject system may be any type of ion source, including, but not limited to an electron ionization (EI) source, atmospheric pressure ionization (API), a matrix assisted laser desorption ionization source (MALDI) operated in vacuum or at atmospheric pressure (AP-MALDI), a high-field asymmetric waveform ion mobility spectrometry (FAIMS), an electrospray ionization (ESI) source, a chemical ionization source (CI) operated in vacuum, or at atmospheric pressure (APCI), glow discharge ionization (GDI) source, or an inductively couple plasma (ICP) source, among others.

In certain embodiments, an ion source of a mass spectrometer system may be connected to an analyte separation for providing a sample containing analytes to the ion source. In certain embodiments, exemplified by apparatus 132 in FIG. 7, the apparatus is an analytical separation device, such as a gas chromatograph (GC) or a liquid chromatograph (LC), including a high performance liquid chromatograph (HPLC), a micro- or nano-liquid chromatograph or an ultra high pressure liquid chromatograph (UHPLC) device, a capillary electrophoresis (CE), or a capillary electrophoresis chromatograph (CEC) apparatus, however, any manual or automated injection or dispensing pump system may be used. In particular embodiments, a sample may be provided by means of a nano- or micropump, for example.

The invention finds general use in methods of sample mass analysis, where a sample may be any material (including solubilized or dissolved solids) or mixture of materials, typically, although not necessarily, dissolved in a solvent. Samples may contain one or more analytes of interest. Samples may be derived from a variety of sources such as from foodstuffs, environmental materials, a biological sample such as tissue or fluid isolated from a subject (e.g., a plant or animal subject), including but not limited to, for example, plasma, serum, spinal fluid, semen, lymph fluid, the external sections of the skin, respiratory, intestinal, and genitourinary tracts, tears, saliva, milk, blood cells, tumors, organs, and also samples of in vitro cell culture constituents (including but not limited to conditioned medium resulting from the growth of cells in cell culture medium, putatively virally infected cells, recombinant cells, and cell components), or any biochemical fraction thereof. Also included by the term "sample" are samples containing calibration standards or reference mass standards.

Components in a sample are termed "analytes" herein. In certain embodiments, the subject methods may be used to investigate a complex sample containing at least about $10^2$, $5\times10^2$, $10^3$, $5\times10^3$, $10^4$, $5\times10^4$, $10^5$, $5\times10^5$, $10^6$, $5\times10^6$, $10^7$, $5\times10^7$, $10^8$, $10^9$, $10^{10}$, $10^{11}$, $10^{12}$ or more species of analyte. The term "analyte" is used herein to refer to a known or unknown component of a sample. In certain embodiments, analytes are biopolymers, e.g., polypeptides or proteins, that can be fragmented into smaller detectable molecules.

All publications and patents cited in this specification are herein incorporated by reference as if each individual publication or patent were specifically and individually indicated to be incorporated by reference. The citation of any publication is for its disclosure prior to the filing date and should not be construed as an admission that the present invention is not entitled to antedate such publication by virtue of prior invention.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. An ion trap assembly comprising:

a) a segmented linear ion trap;

b) an insulator disposed around said segmented linear ion trap; and c) a bonding material for attaching and spacing said insulator and said segmented linear ion trap;

whereby said insulator is spaced from said segmented linear ion trap.

2. The ion trap assembly of claim 1, wherein said bonding material is a cured adhesive.

3. The ion trap assembly of claim 1, wherein said insulator is ceramic.

4. The ion trap assembly of claim 1, wherein said segmented linear ion trap comprises three segments.

5. The ion trap assembly of claim 1, wherein said segmented linear ion trap comprises rods that are hyperbolic in cross-section.

6. The ion trap assembly of claim 5, wherein at least one of rods comprises a slot.

7. The ion trap assembly of claim 6, wherein said slot is along an entire length of said rod.

8. The ion trap assembly according to claim 1, wherein said segmented linear ion trap is made from a single monolithic workpiece by electron discharge machinery.

9. An ion trap assembly comprising:

a) a segmented linear ion trap comprising a first section, a second section and a third section;

b) a first insulator disposed around said first section but not in direct contact with said first section;

c) a second insulator disposed around said second section but not in direct contact with said second section;

d) a third insulator disposed around said third section but not in direct contact with said third section; and e) a bonding material that attaches said first, second and third insulators to said first, second and third sections.

10. The ion trap assembly of claim 9, wherein said bonding material is a cured adhesive.

11. The ion trap assembly of claim 9, wherein said insulator is ceramic.

12. The ion trap assembly of claim 9, wherein said segmented linear ion trap comprises three segments.

13. The ion trap assembly of claim 9, wherein said segmented linear ion trap comprises rods that are hyperbolic in cross-section.

14. The ion trap assembly of claim 13, wherein at least one of rods comprises a slot.

15. The ion trap assembly of claim 14, wherein said slot is along an entire length of said rod.

16. A mass spectrometer system comprising:

A) an ion source;

B) an ion trap assembly downstream of said ion source, comprising:

a) a segmented linear ion trap;

b) an insulator disposed around said segmented linear ion trap; and c) a bonding material for attaching and spacing said insulator and said segmented linear ion trap;

C) an ion detector downstream of said ion trap assembly for detecting ions.

17. The mass spectrometer system of claim 16, wherein said ion source comprises at least one selected from the group consisting of MALDI, AP-MALDI, FAIMS, API, ESI, APCI, EI, GDI and ICP ion source.

18. The mass spectrometer system of claim 16, wherein said ion source is connected to an analyte chromatography system.

* * * * *